US010418683B2

(12) United States Patent
Bensen et al.

(10) Patent No.: US 10,418,683 B2
(45) Date of Patent: Sep. 17, 2019

(54) METHOD AND APPARATUS FOR POINT-N-GO ANTENNA AIMING AND TRACKING SYSTEM

(71) Applicant: Broadband Antenna Tracking Systems, Inc., Indianapolis, IN (US)

(72) Inventors: Steven D. Bensen, Zionsville, IN (US); Alex W. Eaton, Sheridan, IN (US); Robert B. Peterson, Brownsburg, IN (US); Matthew C. Creakbaum, Carmel, IN (US); Robert L. Bruder, Indianapolis, IN (US)

(73) Assignee: Broadband Antenna Tracking Systems, Inc., Indianapolis, IN (US)

( * ) Notice: Subject to any disclaimer, the term of this patent is extended or adjusted under 35 U.S.C. 154(b) by 255 days.

(21) Appl. No.: 15/344,214

(22) Filed: Nov. 4, 2016

(65) Prior Publication Data

US 2017/0133740 A1 May 11, 2017

Related U.S. Application Data

(60) Provisional application No. 62/252,403, filed on Nov. 6, 2015.

(51) Int. Cl.
*H01Q 1/12* (2006.01)
*H01Q 3/06* (2006.01)

(52) U.S. Cl.
CPC ..... *H01Q 1/1264* (2013.01); *H01Q 3/06* (2013.01)

(58) Field of Classification Search
CPC ..... H01Q 1/125; H01Q 3/08; H01Q 1/1235
See application file for complete search history.

(56) References Cited

U.S. PATENT DOCUMENTS 4,602,259 A 7/1986 Shepard
4,888,592 A 12/1989 Paik et al.
5,657,031 A * 8/1997 Anderson ..... H01Q 1/125 343/757
5,999,139 A 12/1999 Benjamin et al.
6,031,508 A * 2/2000 Ishizuka ..... H01Q 1/125 343/878

(Continued)

FOREIGN PATENT DOCUMENTS

WO WO2006075086 A1 7/2006

OTHER PUBLICATIONS

International Search Report and Written Opinion issued by the ISA/US, Commissioner for Patents, dated Jan. 30, 2017, for International Application No. PCT/US2016/060526; 9 pages.

*Primary Examiner* — Bradley Duckworth
(74) *Attorney, Agent, or Firm* — Faegre Baker Daniels LLP

(57) ABSTRACT

An apparatus is provided comprising a clamping portion and a coupling portion, the clamping portion structured to be clamped to a support structure; a mating bracket configured to couple at least one of a radio or an antenna to the coupling portion; a first guide arm disposed intermediate the clamping portion and the coupling portion, the first guide arm structured to enable movement of at least one of the radio or the antenna; and at least one actuator comprising an extendable portion, wherein while extending, the extendable portion causes movement, via the first guide arm, of the coupling portion relative to the clamping portion, thereby rotating at least one of the radio or the antenna along a first axis.

4 Claims, 5 Drawing Sheets

(56) References Cited

U.S. PATENT DOCUMENTS

| | | | | |
|---|---|---|---|---|
| 6,407,713 | B1 * | 6/2002 | Mallenius | F16M 11/10 343/765 |
| 6,484,987 | B2 * | 11/2002 | Weaver | F16M 11/10 248/278.1 |
| 6,559,806 | B1 * | 5/2003 | Watson | H01Q 1/125 343/758 |
| 6,850,202 | B2 | 2/2005 | Watson | |
| 6,956,526 | B1 * | 10/2005 | Lundstedt, Jr. | H01Q 1/1257 342/359 |
| 7,113,144 | B2 * | 9/2006 | Lin | H01Q 1/125 343/880 |
| 7,408,526 | B2 * | 8/2008 | Pan | H01Q 1/125 343/880 |
| 7,791,553 | B2 | 9/2010 | Conrad | |
| 8,020,824 | B2 * | 9/2011 | Pan | F16M 11/10 248/222.51 |
| 8,941,554 | B2 * | 1/2015 | Christie | G05G 5/06 16/235 |
| 9,136,582 | B2 * | 9/2015 | Lewry | H01Q 1/125 |
| 9,172,137 | B2 * | 10/2015 | Lee | H01Q 3/06 |
| 9,634,373 | B2 * | 4/2017 | Lee | H01Q 1/1228 |
| 9,966,649 | B2 * | 5/2018 | Christie | F16M 13/022 |
| 2002/0083574 | A1 * | 7/2002 | Matz | H01Q 1/125 29/600 |
| 2010/0127946 | A1 * | 5/2010 | Tung | H01Q 3/08 343/763 |
| 2015/0144758 | A1 * | 5/2015 | Kolokotronis | H01Q 1/1228 248/282.1 |
| 2017/0288292 | A1 * | 10/2017 | Renilson | H01Q 1/1228 |
| 2017/0317398 | A1 * | 11/2017 | Moheb | H01Q 1/125 |
| 2018/0115047 | A1 * | 4/2018 | Tsukada | H01Q 3/08 |

* cited by examiner

METHOD AND APPARATUS FOR POINT-N-GO ANTENNA AIMING AND TRACKING SYSTEM

CROSS-REFERENCE TO RELATED APPLICATION

This application claims priority to U.S. Provisional Patent Application No. 62/252,403, filed Nov. 6, 2015, the disclosure of which is expressly incorporated by reference herein.

FIELD OF THE DISCLOSURE

The present disclosure generally relates to a method and apparatus for controlled antenna alignment, and more specifically, to a method and apparatus that optimizes antenna throughput through accurate aiming, alignment and fixed position capabilities.

BACKGROUND OF THE DISCLOSURE

Various communications systems are known in the art which allow for point-to-point data connections to be established between two exemplary antenna systems. In current mobile communications systems, the majority of the antennas, are single structures providing omni-directional Radio Frequency ("RF") coverage and are typically mounted in the same plane as other antennas on the top side of buildings and various mobile platforms. Commonly-used omni-directional antennas in such communications systems are not always capable of achieving the desired combination of operating distance and bandwidth speed necessary in modem data and video communications. Therefore, improved communications systems such as antenna aiming and tracking system are needed to assist in, for example, locating, locking onto, optimizing, and tracking the data links associated with at least two antenna systems in distinct physical locations. The present disclosure provides a method and apparatus that provides needed improvements in antenna aiming and alignment technology.

SUMMARY OF THE DISCLOSURE

In one embodiment of the present disclosure, a bracket is provided comprising: a clamping portion and a coupling portion, the clamping portion structured to be clamped to a support structure; a mating bracket configured to couple at least one of a radio or an antenna to the coupling portion; a first guide arm disposed intermediate the clamping portion and the coupling portion, the first guide arm structured to enable movement of at least one of the radio or the antenna; and at least one actuator comprising an extendable portion, wherein while extending, the extendable portion causes movement, via the first guide arm, of the coupling portion relative to the clamping portion, thereby rotating at least one of the radio or the antenna along a first axis.

In another embodiment of the present disclosure, a system is provided comprising a clamping portion and a coupling portion, the clamping portion clamped to a support structure; a mating bracket configured to couple at least one of a radio or an antenna to the coupling portion; a first guide arm disposed intermediate the clamping portion and the coupling portion, the first guide arm structured to enable movement of at least one of the radio or the antenna; and at least one actuator coupled to a controller, the at least one actuator comprising an extendable portion; and wherein the controller includes at least one processor and memory containing instructions that when executed by the processor causes at least one of: the extendable portion to extend and move the coupling portion relative to the clamping portion thereby rotating at least one of the radio or the antenna along a first axis wherein movement of the coupling portion occurs by way of the first guide arm.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

The embodiments disclosed herein are not intended to be exhaustive or to limit the disclosure to the precise forms disclosed in the following detailed description. Rather, the embodiments were chosen and described so that others skilled in the art may utilize their teachings.

Figure 1:
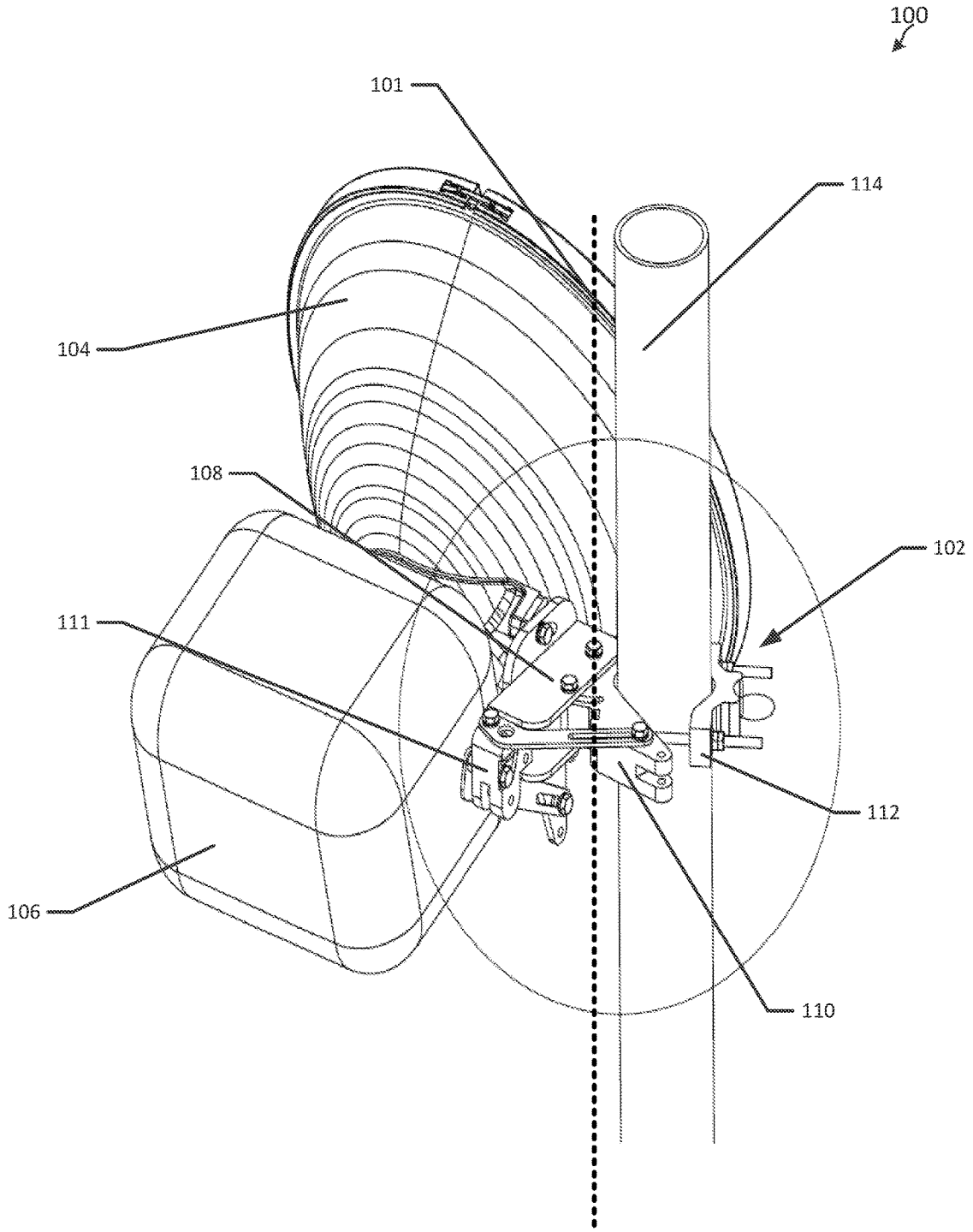
FIG. 1 shows an antenna aiming and tracking system according to an embodiment of the present disclosure.

FIG. 1 shows an antenna aiming and tracking system 100 (hereinafter "system 100") according to an embodiment of the present disclosure. In the illustrative embodiment of FIG. 1, system 100 generally includes first axis 101, second axis (not shown), aiming bracket 102, antenna 104, radio 106, and pipe 114. In certain embodiments, pipe 114 may be a shaft or other support structure type device configured to support antenna 104 and radio 106 via aiming bracket 102. Aiming bracket 102 generally includes coupling bracket 108, first clamp member 110, bracket portion 111, and second clamp member 112. In various embodiments, radio 106 is conventional radio device configured to produce a plurality of radio signals or electromagnet waves of radio frequency ("RF") signals. In certain embodiments, the signals may be modulated to include a variety of data such as sound/audio, video and other analog and/or digital data transmissions. Similarly, antenna 104 may be a conventional antenna device configured to transmit the plurality of RF signals produced by radio 106. In one embodiment, antenna 104 may be a high gain narrow beam antenna and radio 106 may be a microwave/broadband radio.

In one embodiment, system 100 is designed to automatically align antenna 104. In this embodiment, system 100 relies, in part, on tight integration with an exemplary microwave/broadband radio such as radio 106 to accomplish automatic alignment of antenna 104. In one embodiment, system 100 may be configured to perform an auto acquire procedure to establish an exemplary high quality data link. In various embodiments, aiming bracket 102 may be used to align antenna 104 and radio 106 to a fixed configuration in which antenna 104 may establish a robust and high quality data connection having optimized bandwidth and throughput capability. In one embodiment, two aiming brackets 102 may be utilized wherein a first aiming bracket 102 facilitates alignment of a first antenna/radio pair (i.e. first side of a data link) and a second aiming bracket 102 facilitates alignment of a second antenna/radio pair (i.e. second side of a data link).

Figure 2:
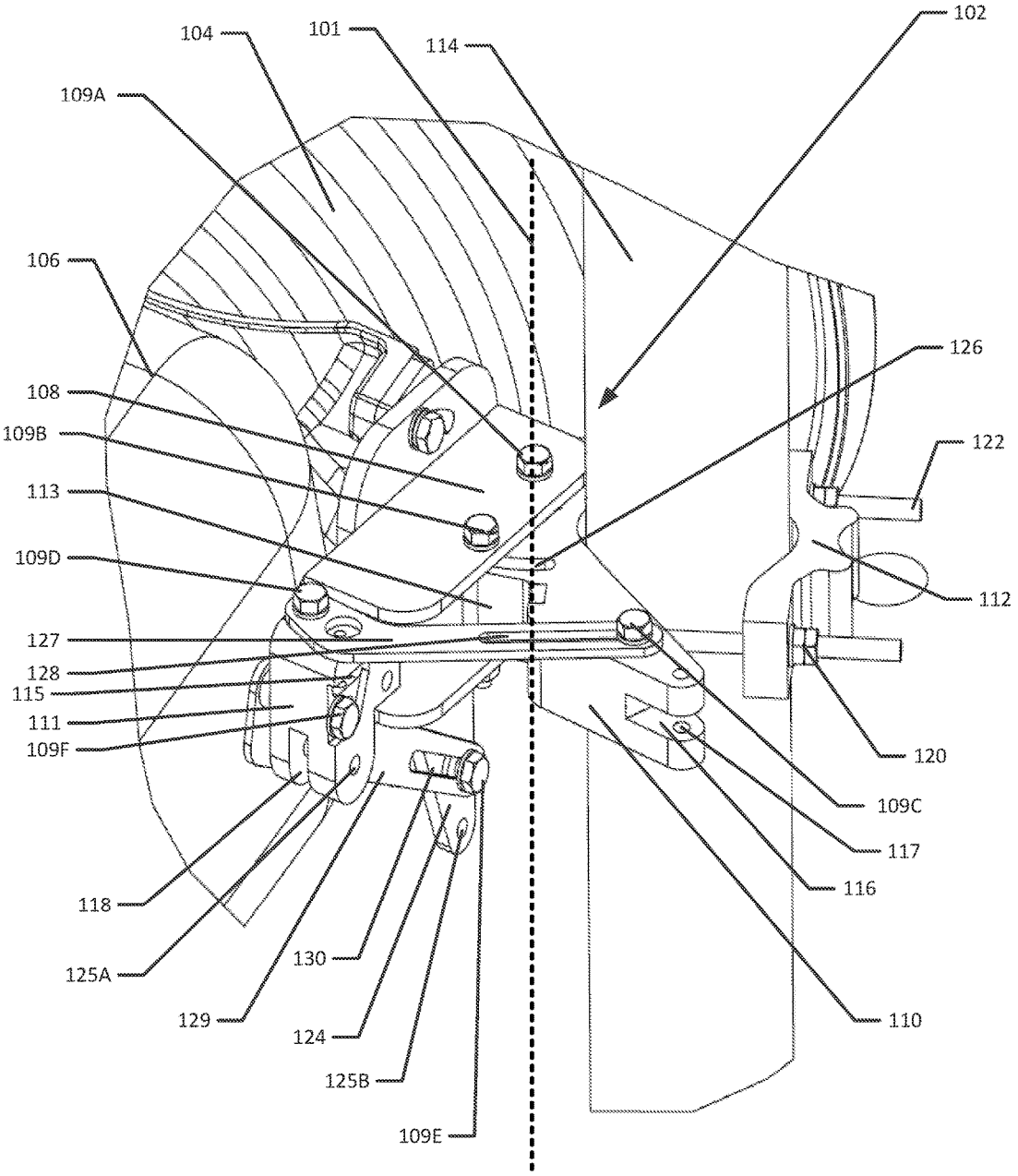
FIG. 2 shows an aiming bracket of the antenna aiming and tracking system of FIG. 1 according to an embodiment of the present disclosure.

FIG. 2 shows an enlarged view of aiming bracket 102 of system 100 according to an embodiment of the present disclosure. In addition to features described in FIG. 1, aiming bracket 102 further includes first clevis 116, second clevis 118, actuator coupling section 124, first guide arm 127, and second guide arm 129. As described in further detail herein below, aiming bracket 102 facilitates coupling of antenna 104 and radio 106 to pipe 114 such that antenna 104 and radio 106 may be aimed and directionally adjusted to establish a robust data link with one or more distant communications systems. In various embodiments of system 100, antenna 104 generally moves in a first direction and in a second direction. In one embodiment, first axis 101 corresponds to azimuth directional movement and second axis corresponds to elevation directional movement. In certain embodiments, aiming bracket 102 enables antenna 104 to scan an azimuth range of ±15 degrees and ±20 degrees in elevation. When limited to scanning ±15 degrees azimuth, system 100 completes antenna 104 aiming in less than five minutes. In one embodiment, system 100 may be controlled from various remote and/or distant locations via, for example, a wireless connection to a web-based system interface. In one embodiment, system 100 may further comprise one or more peripheral equipment (not shown) such as, for example, a control unit, cables and fastening hardware. In one embodiment, the control unit is a battery powered controller and is configured to supply power to the various electromechanical devices of system 100.

As shown in the illustrative embodiment of FIG. 2, aiming bracket 102 comprises a plurality of mechanical hardware structured to securely couple antenna 104 and radio 106 to pipe 114. In various embodiments, the installation and configuration of aiming bracket 102 may be described as follows. First clamp member 110 includes at least two clamping extensions 122 and second clamp member 112 includes at least two through-holes structured to receive extensions 122. Clamp member 110 includes a curved section that is positionable adjacent a first curved exterior section of pipe 114; likewise clamp member 112 also includes a curved section positionable adjacent a second curved exterior section of pipe 114. Extensions 122 of clamp member 110 are received by clamp member 112 via the at least two through-holes (not shown) such that member 110 couples to member 112 and is secured and/or clamped to pipe 114 via fastening member 120. First clamp member 110 is coupled to coupling bracket 108 via one or more bolts 109A and 109B. In one embodiment, coupling bracket 108 is generally U shaped and includes a receiving slot 113 structured to receive a portion of first clamp member 110. Clamp member 110 cooperates with coupling bracket 108 such that antenna 104 may move or rotate in an azimuth direction via axis 101 defined by bolt 109A. In various embodiments, system 100 may generally include a plurality of bolts and/or other fastening devices such as nuts, washers, screws and/or other conventional threaded or non-threaded retainer devices that allow secure coupling of mechanical hardware associated with system 100.

In one embodiment, clamp member 110 includes a slot 126 configured to receive a shaft section (not shown) of bolt 1096 such that the bolt 1096 moves slidably in slot 126 when antenna 104 moves or rotates in an azimuth direction. In one embodiment, aiming bracket 102 further includes a first guide arm 127 having a receiving slot 128 and a second guide arm 129 having a receiving slot 130. First guide arm 127 guides coupling bracket 108 and generally enables bracket 108 to move and/or rotate relative to clamp member 110. In various embodiments, bolt 109C couples a first end of guide arm 127 to clamp member 110 and bolt 109D couples a second end of guide arm 127 to bracket portion 111. As described in further detail in the disclosed embodiment of FIG. 5A, bracket portion 111 further includes a slot 115 that receives a first end of an exemplary actuator device. Receiving slot 128 is configured to receive a shaft section (not shown) of bolt 109C such that the bolt 109C moves slidably in slot 128 when antenna 104 moves or rotates in an azimuth direction. Second guide arm 129 guides coupling section 124 and generally enables section 124 to move and/or rotate relative to coupling bracket 108.

In various embodiments, bolt 109E couples a first end of guide arm 129 to coupling section 124 and bolt 109F couples a second end of guide arm 129 to bracket portion 111. Receiving slot 130 is configured to receive a shaft section (not shown) of bolt 109E such that bolt 109E moves slidably in slot 130 when antenna 104 moves or rotates in an elevation direction. Bracket portion 111 couples to coupling bracket 108 via one or more bolts (not shown) and includes clevis 118 having actuator coupling hole 125A. Likewise, actuator coupling section 124 includes a coupling hole 125B that cooperates with hole 125A to securely couple an exemplary actuator to aiming bracket 102. Similarly, clamp member 110 includes clevis 116 having at least two actuator coupling holes 117 for coupling another exemplary actuator to aiming bracket 102. As described in further detail in the disclosed embodiment of FIG. 4, system 100 may include one or more actuators having an extendable portion such as a piston or similar extender. In one embodiment, extending the extendable portion or piston of a first actuator causes movement of the coupling bracket 108 via guide arm 127 thereby causing antenna 104 to move or rotate about axis 101.

Figure 3:
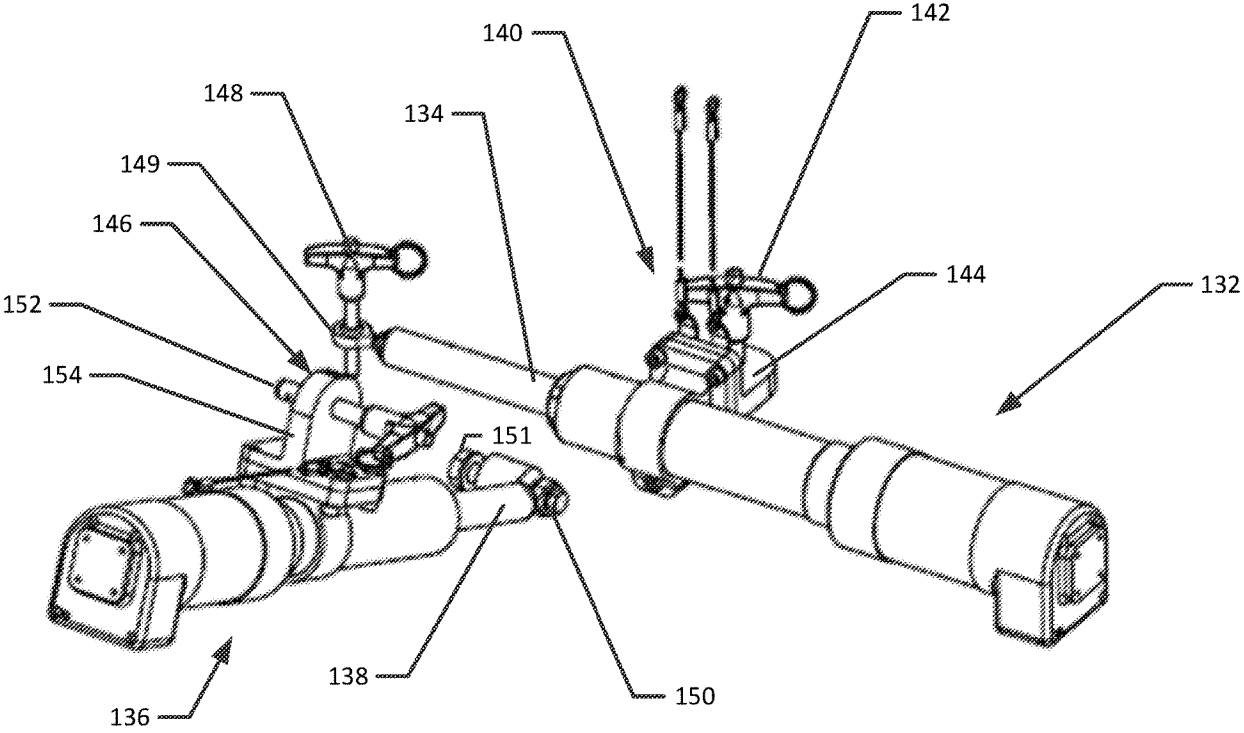
FIG. 3 shows a plurality of actuators for use with the antenna aiming and tracking system of FIG. 1 according to an embodiment of the present disclosure.

FIG. 3 shows a first actuator 132 and a second actuator 136 according to an embodiment of the present disclosure. First actuator 132 generally includes extendable portion/piston 134 and coupling member 140 comprising locking pin 142 and clevis member 144. Actuator 132 further includes locking pin 148 and piston 134 includes loop 149 configured to receive locking pin 148. Second actuator 136 generally includes extendable portion/piston 138 and first coupling member 146 comprising locking pin 152 and clevis member 154. Second actuator 136 further includes second coupling member 150 having a removable bolt 151 for securing/attaching an end section of actuator 136 to coupling section 124 via couple hole 125B. In one embodiment, first actuator 132 and second actuator 136 may have the following technical specifications: Travel: 3.75 inch; Force: Peak 225 lbs at 0.40 inches per second and 100 lbs cont.; Backlash: less than 0.005 inch; ARE shelf: locking (max static load 500 lbs); Voltage: 24 VDC; Control protocol: Smart Serial and Universal Serial Bus (USB); Resolution: >0.001-inch.

Figure 4:
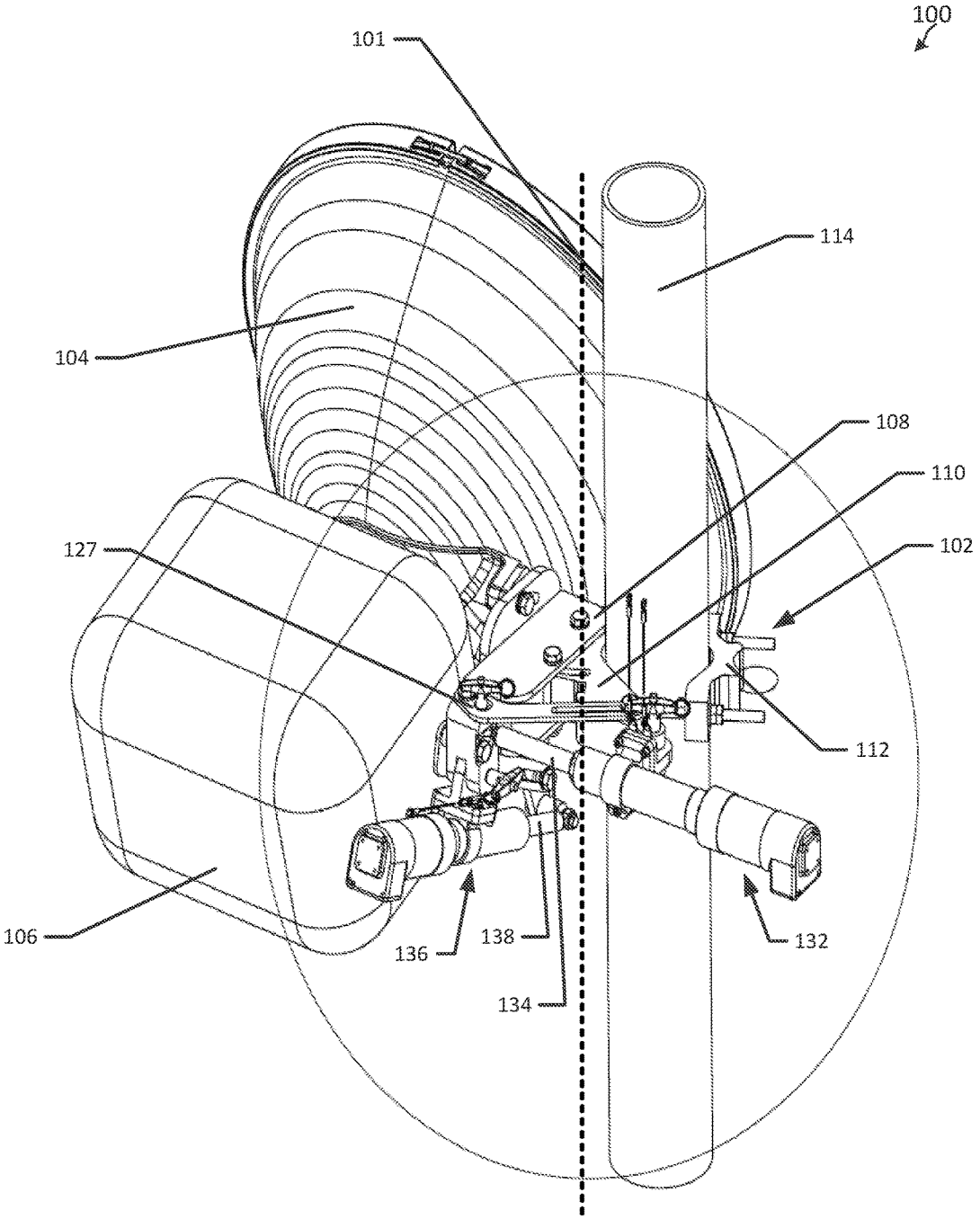
FIG. 4 shows an antenna aiming and tracking system according to an embodiment of the present disclosure.
Figure 5A:
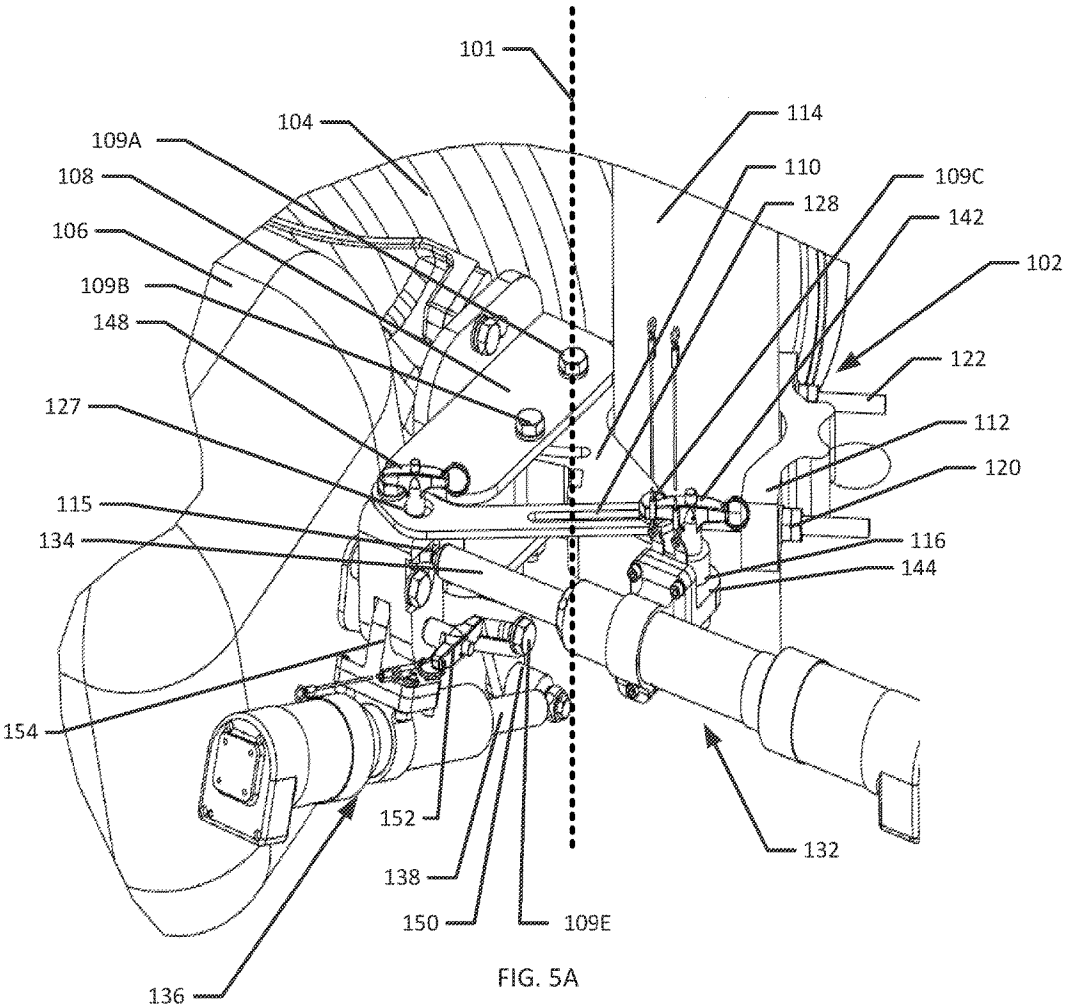
FIGS. 5A and 5B show enlarged views of two sections of the antenna aiming and tracking system of FIG. 4 according to an embodiment of the present disclosure.
Figure 5B:
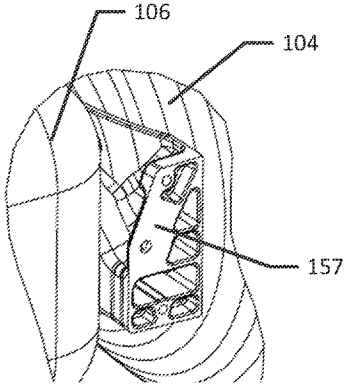

FIG. 4 shows system 100 and aiming bracket 102 having first actuator 132 and second actuator 136 installed according to an embodiment of the present disclosure. The illustrative embodiment of FIG. 4 provides a system level view of system 100 and should be viewed in conjunction with the illustrative embodiment of FIG. 5. As such, in the present disclosure, the embodiment of FIG. 4 will be described in combination with the embodiment of FIG. 5A. The illustrative embodiment of FIG. 5B shows an exemplary mating section 157 for mating or attaching aiming bracket 102 to antenna 104 and radio 106. The illustrative embodiment of FIG. 5A shows an enlarged view of aiming bracket 102 having first actuator 132 and second actuator 136 installed according to an embodiment of the present disclosure. In various embodiments, a first section of actuator 132 is connected or coupled to clamp member 110 via clevis 116 receiving clevis member 144 and locking pin 142 securing member 144 within clevis 116 via actuator coupling hole (through-hole) 117. Extendable portion 134 of actuator 132 is coupled to bracket portion 111 via slot 115 receiving loop 149 and locking pin 148 securing loop 149 within slot 115. Likewise, a first section of actuator 136 is connected or coupled to bracket portion 111 via clevis 118 receiving clevis member 154 and locking pin 152 securing member 154 within clevis 118 via actuator coupling hole (through-hole) 125A. Extendable portion 138 of actuator 136 is coupled to coupling section 124 via coupling hole 125B receiving a portion of coupling member 150 and removable bolt 151 securing a portion of coupling member 150 within coupling hole 125B.

As discussed above, in one embodiment, first axis 101 corresponds to azimuth directional movement and second axis corresponds to elevation directional movement. Clamp member 110 cooperates with coupling bracket 108 and bracket portion 111 such that antenna 104 moves or rotates in an azimuth direction via axis 101 defined by bolt 109A. Additionally, guide arm 127 guides coupling bracket 108 and generally enables bracket 108 to move and/or rotate relative to clamp member 110. Slot 128 receives a shaft section (not shown) of bolt 109C such that the bolt 109C moves slidably in slot 128 when antenna 104 moves or rotates in an azimuth direction. As shown in the illustrative embodiment of FIG. 4 and FIG. 5A, actuator 132 thereby provides azimuth directional movement of antenna 104 and radio 106 about first axis 101 when piston 134 extends against bracket portion 111 in response to a voltage being applied to actuator 134.

Guide arm 129 guides coupling section 124 and generally enables section 124 to move and/or rotate relative to coupling bracket 108. Slot 130 receives a shaft section (not shown) of bolt 109E such that bolt 109E moves slidably in slot 130 when antenna 104 moves or rotates in an elevation direction. Actuator 136 thereby provides elevation directional movement of antenna 104 and radio 106 about second axis when piston 138 extends against coupling section 124 in response to a voltage being applied to actuator 136. In one embodiment, piston 134 of actuator 132 and piston 138 actuator 136 may each simultaneously extend and/or retract during either azimuth and/or elevation directional movement of antenna 104 and radio 106. In one embodiment, upon directional adjustment of antenna 104 and radio 106, actuator 132 and 136 are removed and antenna 104 and radio 106 may remain fixed position by, for example, tightening bolts 109B, 109C, and 109E.

In one embodiment, system 100 includes a control unit such as conventional controller (not shown) including at least one processor and memory. As used herein, the term controller or control unit may refer to an Application Specific Integrated Circuit (ASIC), an electronic circuit, a processor (shared, dedicated, or group) and memory that execute one or more software or firmware programs/instructions, a combinational logic circuit, and/or other suitable components that provide the described functionality. The controller may be configured to provide one or more control signals to actuator 132 and/or actuator 134 to cause actuation or movement of the actuators which thereby causing antenna 104 and radio 106 to move and be aimed or directionally adjusted in one of an azimuth and/or elevation direction.

In the foregoing specification, specific embodiments of the present disclosure have been described. However, one of ordinary skill in the art will appreciate that various modifications and changes can be made without departing from the scope of the disclosure as set forth in the claims below. Accordingly, the specification and figures are to be regarded in an illustrative rather than a restrictive sense. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued. No claim element herein is to be construed under the provisions of 35 U.S.C. 112(f) unless the element is expressly recited using the phrase "means for."

The invention claimed is:

1. An aiming bracket for aiming an antenna, comprising:

a first clamp member configured to be secured to a support;

a coupling bracket attached to the first clamp member by at least one first bolt;

an actuator coupling section attached to the coupling bracket by at least one second bolt and configured to attach to a mating section connected to an antenna; and a first guide arm coupled between the coupling bracket and the first clamp member, the first guide arm being pivotally attached to the coupling bracket and having a slot for receiving the at least one first bolt, wherein the at least one first bolt moves within the slot as the antenna is moved in the azimuth direction and inhibits further movement of the coupling bracket when the at least one first bolt is in a tightened state, and the coupling bracket is movable relative to the first clamp member to move the antenna in an azimuth direction when the at least one first bolt is in a loosened state, and the actuator coupling section is movable relative to the coupling bracket to move the antenna in an elevation direction when the at least one second bolt is in a loosened state.

2. The aiming bracket of claim 1, further comprising a second clamp member having a pair of openings, the first clamp member having a pair of clamping extensions that are received by the openings of the second clamp member to secure the bracket to the support.

3. The aiming bracket of claim 1, wherein the first clamp member includes a clevis configured to attach to an actuator to move the coupling bracket relative to the first clamp member.

4. The aiming bracket of claim 1, wherein the actuator coupling section is pivotally attached to the coupling bracket.

* * * * *